US005409193A

United States Patent [19]

Baxter

[11] Patent Number: 5,409,193

[45] Date of Patent: Apr. 25, 1995

[54] INSULATED CONCRETE WALL TIE SYSTEM

[76] Inventor: Kenneth I. Baxter, 19475 200th, Big Rapids, Mich. 49307

[21] Appl. No.: 217,260

[22] Filed: Mar. 24, 1994

[51] Int. Cl.[6] ..... E04B 2/84; E04G 17/06

[52] U.S. Cl. ..... 249/43; 249/45; 249/46; 249/47; 249/91; 249/190; 249/196; 249/217; 52/701; 52/706; 52/708

[58] Field of Search ..... 249/40, 43, 46, 47, 249/91, 93, 111, 190, 196, 193, 213, 215, 216, 217, 45; 52/699, 701, 706, 708, 712

[56] References Cited

U.S. PATENT DOCUMENTS

| | | | |
|---|---|---|---|
| 2,313,880 | 3/1943 | Leggett, Sr. | 249/193 |
| 3,167,842 | 2/1965 | Pauli | 249/46 |
| 3,173,187 | 3/1965 | Pontiere | 249/91 |
| 3,994,471 | 11/1976 | Turolla | 249/193 |
| 4,234,156 | 11/1980 | Wepf | 249/40 |
| 4,239,173 | 12/1980 | Sawyer | 249/190 |
| 4,936,540 | 6/1990 | Boeshart | 249/40 |
| 5,107,648 | 4/1992 | Roby | 52/699 |
| 5,209,039 | 5/1993 | Boeshart | 249/40 |
| 5,323,578 | 6/1994 | Chagnon et al. | 249/215 |

*Primary Examiner*—Khanh Nguyen
*Attorney, Agent, or Firm*—Price, Heneveld, Cooper, DeWitt & Litton

[57] ABSTRACT

Apparatus for in situ attachment of insulation panels to poured concrete walls as the walls are formed. Preferably, polymeric F-shaped strips are attached to novel tie bars by transverse retainers, and receive the edges of insulation panels to hold them against the forms so that uncured concrete is poured between the forms and against the panels. After the concrete is cured, the forms are removed, leaving the insulation panels and the strips, the strips serving to receive dry wall fasteners.

8 Claims, 2 Drawing Sheets

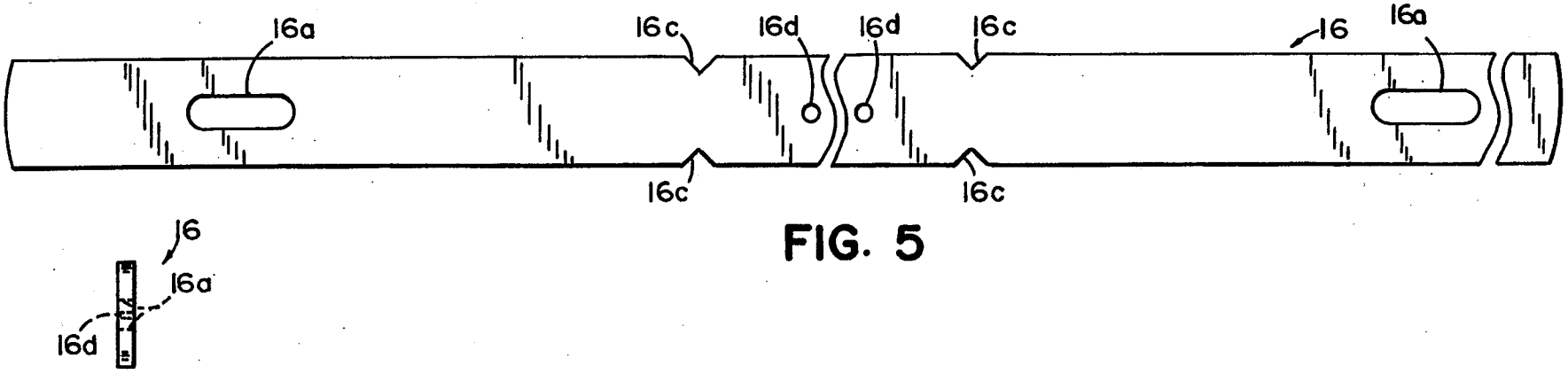
FIG. 5
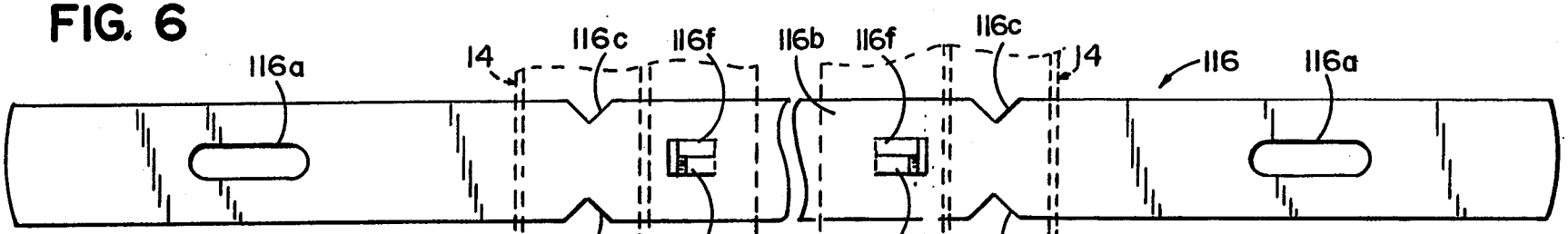
FIG. 6
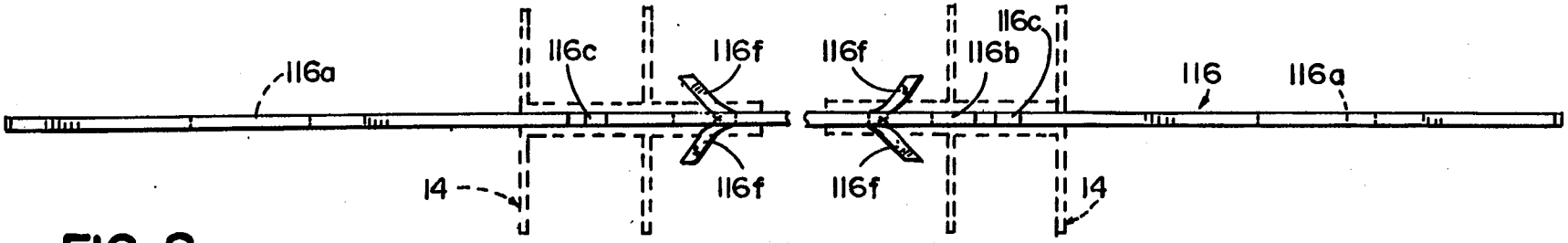
FIG. 7
FIG. 8

INSULATED CONCRETE WALL TIE SYSTEM

BACKGROUND OF THE INVENTION

This invention relates to poured concrete walls, and particularly to apparatus and a method for forming insulated poured concrete walls.

The forming of foundation/basement walls of poured concrete is conventional. To form a poured wall, forms are secured together astraddle a space which is later filled with uncured concrete. The concrete is then left to solidify and cure, the forms are removed, and the notched protruding ends of the metal ties which were used to secure the forms together are knocked off as with a hammer. If these ends of the ties are not removed, thermal conductivity thereof causes excess heat transfer with resultant increased energy usage. Even with the tie ends removed, the concrete walls conduct sufficient heat to cause considerable extra energy use.

Therefore, thermal insulation is sometimes applied to the cured concrete walls as by spraying it on, or a layer of insulation may be glued to the inside and/or outside wall surfaces. These insulation application processes, however, involve considerable added time and labor, so that normally the walls remain uninsulated. Yet, application of thermal insulation is particularly advantageous for decreasing energy costs. Indeed, in some jurisdictions the R value must meet certain minimum requirements.

SUMMARY OF THE INVENTION

An object of this invention is to provide a novel apparatus and method for applying thermal insulation to one or both poured concrete walls at the time the walls are poured. One or two insulation panels of selected thickness are specially retained in proper position on the inside walls of the forms so as to be on the inside and/or outside surfaces of the poured wall. Then the concrete is injected, e.g., poured into the forms and against the insulation, cured, and the forms later removed. The result is that the wall is already insulated to the extent desired, i.e., subsequent insulation application steps are not necessary. The apparatus employed includes novel ties which not only secure the forms in spaced relationship, but which are longer than the conventional ties, having special insulation retention means attached thereto for retaining foam insulation layers or panels in position against the forms, adjacent the space to receive the poured concrete, so that the uncured concrete is formed directly against the insulation layer or layers. The insulation panels are retained in position by strips, preferably elongated, low-heat conductance, F-shaped strips as of polymer, these strips being held to the ties by transverse retainers. In one embodiment, these transverse retainers comprise insertable pins such as nails which fit into openings through the strips, and matching openings through the ties. In another embodiment, these transverse retainers take the form of a pair of ears integrally formed from the ties and extending into orifices in the strips.

When the forms are ultimately removed, the strips remain on the finished wall with the insulation panels, serving as a base for attaching drywall screw fasteners, for example. The added components including strips and insulation do not interfere with the ability to knock the extended notched ends of the ties off the poured wall.

The novel method involves attachment of strips to the concrete forms to hold insulation layers, insertion of one or two layers of insulation as desired, preferably self supporting foam insulation panels, against the inside walls of tile forms, with their edges retained in the strips and their inside face adjacent the space to receive the poured concrete, the strips holding the layers or panels of insulation while pouring the concrete into the space and against the insulation layer or layers. Subsequently the concrete is cured, and tile forms removed while leaving tile strips with the insulation. Eventually, the notched ends of the ties are broken off.

These and other objects, advantages and features of the invention will become apparent upon studying the following specification in conjunction with the drawings.

BRIEF DESCRIPTION, OF THE DRAWINGS

FIG. 5 is a side elevational view of one embodiment of the novel form tie;

FIG. 6 is an end elevational view of the form tie in FIG. 5;

FIG. 7 is a top plan view of another embodiment of the novel form tie; and

FIG. 8 is a front elevational view of the tie in FIG. 7.

DESCRIPTION OF THE PREFERRED EMBODIMENT

Figure 1:
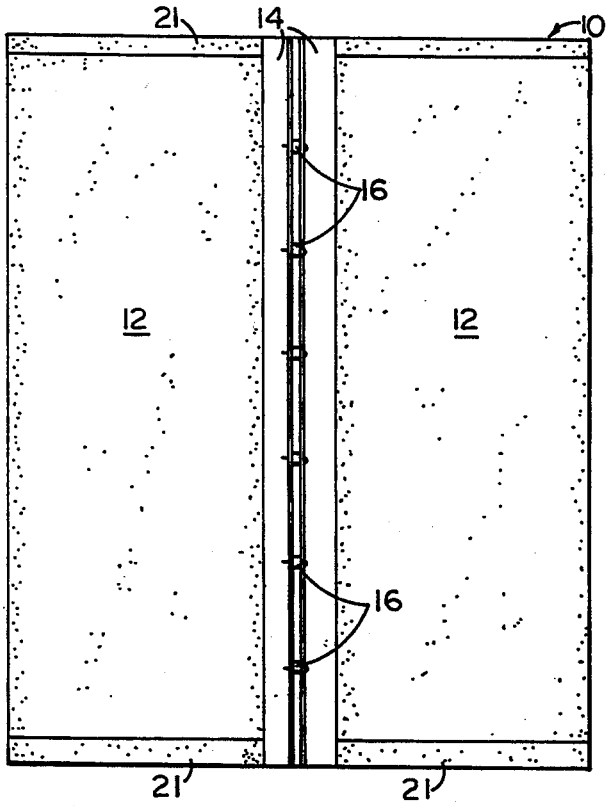
FIG. 1 is a side elevational view of a section of foam insulated concrete wall with strips in place.

Referring now specifically to the drawings, in FIG. 1 is depicted a portion of a poured concrete wall assembly 10 formed in accordance with this invention, the elevational view representing either tile inside or outside wall portions, there being visible two adjacent insulation panels or layers 12 having their adjacent edges enveloped by and straddling a pair of strips 14 positioned back-to-back. Between these strips and insulation panels 12, the ends of a plurality (here six) of elongated, transverse, metal form ties 16 extend through and from the poured concrete wall against which the insulation and strips are retained.

Figure 3:
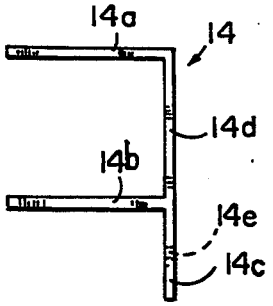
FIG. 3 is an end elevational view of the F-strip shown in FIGS. 1 and 2.
Figure 4:
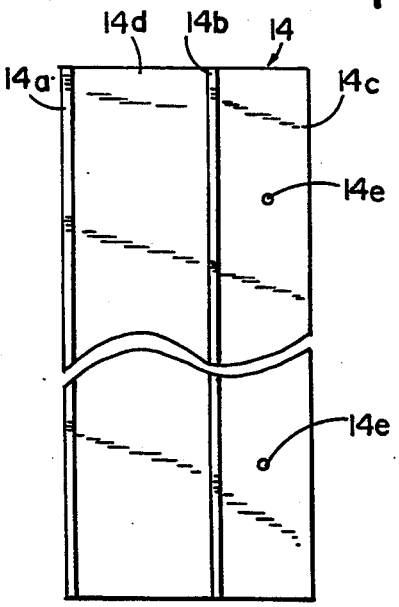
FIG. 4 is a fragmentary front elevational view of the strip in FIG. 3.

Each of elongated strips 14 is preferably of the F-shaped configuration depicted in FIGS. 3 and 4, having a U-shaped socket portion formed of a pair of parallel spaced extending legs **14*a* and 14*b* and a cross leg 14*d* therebetween, and including a flange 14*c* extending beyond this U-shaped configuration and in effect being an extension of cross leg 14*d*. Flange 14*c* has one or more orifices or openings 14*e* therethrough for receipt of transverse fasteners such as pins 20 in tile form of nails or the like, in a manner to be described more fully hereinafter. Openings 14*e* in the strip are spaced at vertical intervals corresponding to the vertical spacing of the tie bars 16**. These strips are formed of a low thermal conductivity material, preferably a polymeric material such as polyvinyl chloride, polyethylene, polypropylene, nylon, or any of several other available materials. The strips can be formed by a conventional extrusion process, and cut to selected length to match the height of the wall to be formed. The strips can also be easily cut on the job site to a particular length as desired.

The preferred strips are those of F-shape as noted and shown, including the U-shaped channel or socket, and the extended flange. Conceivably other configurations could be employed. For example, U-shaped strips would serve to receive and retain the insulation panels. Attachment of the strips to the tie bars could be through the cross leg of the U so as to tend to protrude somewhat into the channel and possibly be undesirable. Attachment could also be by way of a double faced tape so as to adhere to the tie bars and/or to the forms.

Another alternative is to have the strips attached to the insulation prior to placement in the forms, and even by the insulation manufacturer. Such attachment could be by adhesive. Instead of the preferred strips, the insulation could be made with an adhesive edge, covered with a removable protective sheet, for adherence to the tie bars and/or the forms.

The strips 14 could also be attached to the forms instead of, or in addition to, attachment to the tie bars.

Optionally, the top and bottom edges of the insulation panels can also be encompassed with strips, e.g., U-strips, to cover them and also to provide receptors for dry wall screws, as noted by phantom lines at 21 in FIG. 1.

These novel form tie bars 16 have some characteristics in common with the conventional tie bars presently used in the trade, and some novel characteristics for functioning in this invention. One such type of novel tie bar is shown at FIGS. 5 and 6 with an alternative embodiment being shown in FIGS. 7 and 8.

Referring first to the tie bar in FIGS. 5 and 6, it has a generally rectangular cross sectional comparable to that of tie bars presently used, includes a pair of laterally elongated, i.e., generally oval-shaped, slots **16*a* at opposite ends thereof for receiving fastener wedges 18 of conventional type, include a central zone 16*b* between pairs of notches 16*c* astraddle this central zone 16*b*, and of a width between the two pairs of notches equal to the thickness of the concrete wall to be formed. This tie bar differs from a conventional tie bar in having a pair of through orifices 16*d* each located in center zone 16*b* a small distance from notches 16*c*. These orifices receive pins 20 (FIG. 2) as explained more fully hereinafter. These tie bars also differ from conventional tie bars in being of greater length, particularly between notches 16*c* and elongated openings 16*a*, to accommodate not only the thickness of conventional concrete forms 22, but also the thickness of the panels or layers of insulation 12. The particular length of the tie bar, and specifically its center zone, depends on the wall thickness to be formed. The length of the tie bar zones between the notches 16*c* and slots 16*a*** will depend on the thickness of the insulation layer to be employed.

Figure 2:
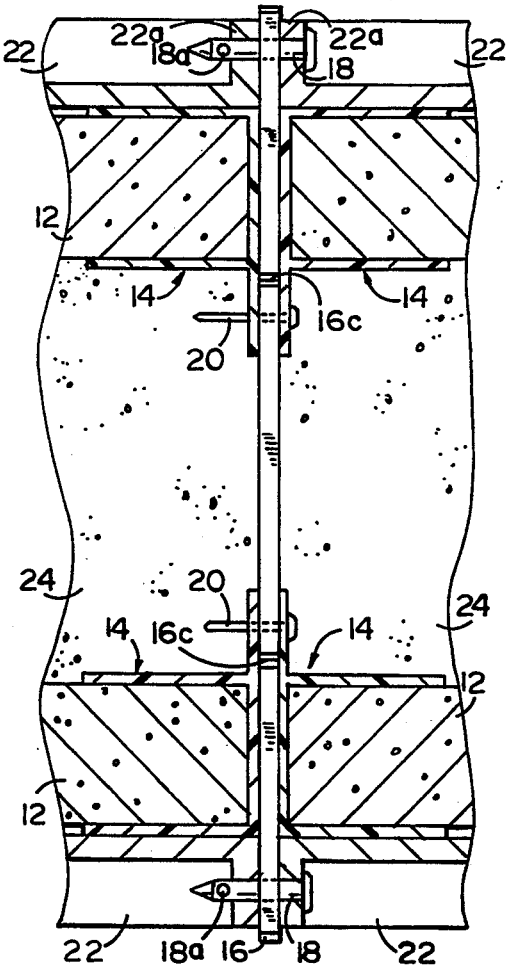
FIG. 2 is a top plan view of the wall in FIG. 1, but with the concrete forms still in place.

In the illustrative embodiment depicted in FIG. 2, insulation is provided on both the inside and outside wall surfaces of the poured concrete wall 24 being formed. This sectional view is taken at a location corresponding to one of the tie bars 16. As an alternative, insulation can, if desired, be applied to only one wall surface of the poured wall. Another variation possible is that of the insulation thickness. For example, this could be one inch, one and one-half inch, two inch, or otherwise. The socket size on the F-strip is selected to match the insulation thickness.

When practicing the method of this invention, the conventional forms 22 are first assembled in pairs in spaced parallel relationship to each other as depicted in FIG. 2, connected together with tie bars 16. Adjacent forms are tied together by extending the tapered wedge elements 18 through adjacent flanges **22*a* of the forms astraddle the ends of tie bars 16 in conventional manner. These wedge elements can be secured in position by nails or other pins extended through openings 18*a* secured in these wedge elements. Next the F-shaped strips 14 are placed vertically inside the forms, either on one or both inside surfaces of the forms, depending upon whether insulation is going to be provided on one wall surface or on both wall surfaces of the concrete wall being formed. These F-strips extend from the top to the bottom of the forms and are attached to tie bars 16 by inserting retention pins 20, e.g., nails, through openings 14*e* in the strips, and openings 16*d* in the tie bars 16. Then the appropriate number of insulation panels 12, e.g., four feet wide and the height of the forms, e.g., eight feet high, are placed with their vertical edges contained within the U-channel or socket of the F-strips, such that the outer surfaces of these insulation panels abut against the forms 22**. These insulation panels are preferably formed of a foam-type, self-supporting polymer, e.g., polyurethane, polystyrene, or other expanded polymers conventionally available in the trade. The thickness of the insulation layer is chosen for the particular R value desired, with the width of the U-channel of the F-strips being correspondingly selected. Uncured concrete is then poured into the space between the insulation panels on both sides, or between insulation panels on one side and forms on the other side. The weight of the uncured concrete causes it to press against the insulation panels for a bonding effect.

After the suitable curing period has been allowed to pass for the concrete to be firm and self supporting, forms 22 are removed in conventional fashion by removing wedge locks 18. This leaves the concrete wall 24 and the adjacent layers of insulation 12, as well as the strips 14, in position as an integral part of the wall. These strips are useful for receiving dry wall fasteners, e.g., screws. The ends of tie bars **16*a* can be snapped off in suitable fashion as by pounding vertically with a hammer on the protruding portions, causing them to break at the notches 16*c*** which are recessed behind the strips and insulation, i.e., at the concrete. The result is a well insulated wall not requiring any additional insulation to be sprayed on, glued on, or otherwise attached.

Referring to FIGS. 7 and 8, an alternative type of retention means is provided for securing the F-strips to the tie bars. Specifically, the tie bar 116 there depicted includes the openings **116*a* of conventional oval or elongated type adjacent the ends thereof, the conventional notches 116*c* to enable breaking off the protruding ends of the tie bars once the concrete has cured and the forms are removed. The tie bar includes a pair of integral ears 116*f* stamped from and extending in opposite directions adjacent each end of the central zone 116*b* of the tie bars to serve as strip retaining means. These ears can fit into cooperative openings, i.e., retention means, such as those shown at 14*e*, or slightly larger openings, in the flanges 14*c* of strips 14 as shown in phantom in FIGS. 7 and 8, to retain these strips in position. In using this particular type of tie bar, no pins or nails 20** need be utilized as retaining means.

Variations of the structure illustrated herein as the preferred embodiment of the invention may be apparent to those in this field once they have studied the above description. Such variations to suit a particular type of installation are considered to be within the scope of tile invention, which is intended to be limited only by the scope of the appended claims and the reasonably equivalent structures and methods to those defined therein.

The embodiments of the invention in which an exclusive property or privilege is claimed are defined as follows:

1. Apparatus for forming insulated poured concrete walls between spaced, parallel, concrete forms, comprising:

a pair of spaced, opposing, parallel form panels;

a plurality of elongated form tie bars for interconnecting said form panels, each said tie bar having openings near the ends thereof for receiving form-retaining wedges, each said tie bar having a central zone generally corresponding to the thickness of the concrete wall, and having strip retaining means in at least one end of said central zone for retaining strips;

a plurality of elongated strips defining elongated sockets configured to receive edges of insulation panels, and having retention means for cooperative engagement with said retaining means to retain said strips against said form panels, said sockets being oriented toward each other to receive the opposite edges of insulation panels.

2. The apparatus in claim 1 wherein each said retaining means comprises insertable pins and pin-receiving orifices in said tie bars, and said retention means comprises pin-receiving openings in said strips.

3. The apparatus in claim 1 wherein said retaining means comprises transverse ears in said ties, and said retention means comprises orifices in said strips for receiving said ears.

4. The apparatus in claim 1 wherein said ties each have retaining means in both ends of said central zone, to be generally astraddle said central zone, said strips being arranged back-to-back at both ends of said central zone for holding insulation panels on both sides of a wall to be poured.

5. The apparatus in claim 1 including insulation panels having the edges thereof in said sockets, to be against said form panels.

6. Apparatus for forming insulated poured concrete walls between concrete forms, comprising:

a pair of spaced parallel form panels;

a plurality of elongated form tie bars for interconnecting said form panels, each said tie bar having openings near the ends thereof for receiving form-retaining wedges, each said tie bar having a central zone generally corresponding to the thickness of the concrete wall, and having strip retaining means astraddle said central zone for retaining strips;

a plurality of elongated F-strips defining a socket and an extending flange, said flange having retention means for cooperative engagement with said retaining means to retain said F-strips against said form panels, and said socket being configurated to receive an edge of an insulation layer.

7. The apparatus in claim 6 wherein each said retaining means comprises insertable pins and pin-receiving orifices in said tie bars, and said retention means comprises pin-receiving openings in said strips.

8. The apparatus in claim 6 wherein said retaining means comprises transverse ears in said tie bars, and said retention means comprises orifices for receiving said ears.

* * * * *

UNITED STATES PATENT AND TRADEMARK OFFICE

CERTIFICATE OF CORRECTION

PATENT NO. : 5,409,193
DATED : April 25, 1995
INVENTOR(S) : Kenneth I. Baxter

It is certified that error appears in the above-indentified patent and that said Letters Patent is hereby corrected as shown below:

Column 2, line 10;

"tile" should be –the–.

Column 2, line 11;

"tile" should be –the–.

Column 2, line 17;

after "DESCRIPTION" delete –,–.

Column 2, line 40;

"tile" should be –the–.

Column 2, line 57;

"tile" should be –the–.

UNITED STATES PATENT AND TRADEMARK OFFICE

CERTIFICATE OF CORRECTION

PATENT NO. : 5,409,193

DATED : April 25, 1995

INVENTOR(S) : Kenneth I. Baxter

It is certified that error appears in the above-indentified patent and that said Letters Patent is hereby corrected as shown below:

Column 4, line 67;

"tile" should be –the–.

Signed and Sealed this

Sixteenth Day of January, 1996

Bruce Lehman

*Attest:*

BRUCE LEHMAN

*Attesting Officer*

*Commissioner of Patents and Trademarks*